US005138558A

United States Patent [19]

Meyer et al.

[11] Patent Number: 5,138,558

[45] Date of Patent: * Aug. 11, 1992

[54] METHOD OF AUTOMATIC CONVEYANCE OF TEXTILE MATERIAL IN RECIPIENTS

[75] Inventors: Urs Meyer, Niederglatt; Niklaus Gartenmann, Winterthur, both of Switzerland

[73] Assignee: Maschinenfabrik Rieter AG, Switzerland

[ * ] Notice: The portion of the term of this patent subsequent to Jan. 29, 2008 has been disclaimed.

[21] Appl. No.: 442,019

[22] Filed: Nov. 28, 1989

[30] Foreign Application Priority Data

Nov. 28, 1988 [CH] Switzerland ..... 4410/88-1

[51] Int. Cl.[5] ..... D01H 9/18

[52] U.S. Cl. ..... 364/478; 364/470; 19/159 A

[58] Field of Search ..... 364/468, 470, 478, 403; 19/159 A, 159 B, 300; 320/2; 209/927

[56] References Cited

U.S. PATENT DOCUMENTS 4,227,848 10/1980 Kriechbaum et al. ..... 19/159 A
4,672,280 6/1987 Honjo ..... 364/478
4,683,619 8/1987 Langen et al. ..... 19/159 A
4,688,300 8/1987 Langen et al. ..... 19/159 A
4,697,310 10/1987 Raasch ..... 19/159 A
4,700,121 10/1987 Neri ..... 320/2
4,987,649 1/1991 Meyer et al. ..... 19/159 A

*Primary Examiner*—Jerry Smith
*Assistant Examiner*—Jim Trammell
*Attorney, Agent, or Firm*—Dority & Manning

[57] ABSTRACT

A method of conveying textile material in cans from a machine delivering textile material to a machine receiving textile material uses a self-propelled conveying carriage guided on a guide track and controlled by a central control unit. Known systems using a self-propelled conveying carriage for automatically transferring cans from one machine to another generally do not permit fully automatic operation without manual intervention. In other words, some manual intervention is required at short intervals of time for such systems. The invention provides in the path of an automatic conveying system a control station in which a central control unit is incorporated and which performs automatic operations, including transmission of control instructions to the carriage, checking can contents and conditions, exchanging defective cans, and exchanging and checking a power supply carried on board the conveying carriage.

23 Claims, 3 Drawing Sheets

METHOD OF AUTOMATIC CONVEYANCE OF TEXTILE MATERIAL IN RECIPIENTS

BACKGROUND OF THE INVENTION

The invention relates to a method of automatic conveyance of textile material in recipients, e.g., cans.

The automatic conveyance of textile material between the various machines of a spinning plant is becoming an increasingly important factor for increasing productivity and quality.

For instance, DE-OS 3 532 172 discloses a system wherein the control of a conveying carriage, the card control means, and the drawframe control means are linked to a central control unit. Also associated with this system and linked to the central control unit is a buffer control adapted to receive full and empty cans.

It therefore becomes possible for the sliver-receiving machine which is disposed after a sliver-delivering machine to be supplied automatically with sliver-filled cans. A can is conveyed to the following machine by means of a conveying carriage running on a stationary guide track.

When in the known system sliver breakages occur, for example, on the drawframe, or when the can becomes unserviceable because of damage, manual intervention is necessary. Manual intervention is also necessary for carriage battery exchange and for clearing sliver residues left in the cans.

Such a system cannot therefore be left to run automatically and without manual intervention over a period of several hours, and instead comprises a semi-automatic system in which various operations must be performed manually.

SUMMARY OF THE INVENTION

It is the object of this invention to propose a method and system wherein the conveyance of cans conveying textile material is fully automatic, and wherein any necessary manual intervention is limited very considerably. It is a further present object that any manual intervention is necessary only at long intervals, and that can exchange requires only a short time.

This problem is solved by the presently disclosed method. Advantageous further aspects of the present method can be gathered from the full disclosure herewith.

When the proposed (i.e., disclosed) method is used in a control station, in the event of a sliver breakage in a subsequent textile material receiving machine, for example, a drawframe, the corresponding can with the sliver remainder in it is supplied to the control station after a reserve sliver has been fed in automatically from a reserve can associated with the defective can.

Depending upon the extent to which the can is found to be filled, either the can is emptied at the control station or the sliver start is searched for by a search device and delivered to clamping and transferring means on the carriage or on the can for return to the drawframe.

Either after a predetermined time interval or at a predetermined timing, the carriage battery is automatically exchanged for a spare battery at the reserve station. The battery removed from the carriage is supplied to a charging station for recharging. After its state of charge has been checked, it can be exchanged after a further time interval for the spare battery then on board the carriage.

Combining a number of automatic operations at one control station advantageously makes it possible to concentrate all the facilities necessary for such operations at a single place. Such simplifies servicing and the checking of the various units.

The provision of relatively small stores (i.e., storage locations) for separated-out defective cans and serviceable cans to be fed in and of a store for textile material removed from the cans helps to spread manual intervention over long periods. Only occasional visual checks are needed during such fully automatic operation based on practice of the present invention.

When different materials, for example, cotton and polyester, are used, the textile material removed at the control station may be supplied to an intermediate store corresponding to the material. Such operation is controlled by the control station computer, which detects and temporarily stores the position previously taken up on the drawframe by the can to be emptied.

In some preferred embodiments, to simplify the system routing instructions may be transmitted to the conveying carriage only during its dwell position at the control station.

The carriage itself preferably may have a simple computer system effective (i.e., operative) to convert the routing signals received from the control station. Other operations such as the loading and unloading of the can and the steering of the carriage are also preferably linked with such computer.

Since cans are damaged only relatively seldom, function testing of the cans may be advantageously performed at predetermined time intervals, rather than continuously.

Performance of all automatic operations at the control station while the carriage remains in a fixed position advantageously enables the complete control station to be compact (i.e., to be of very reduced external dimensions).

Also, to increase capacity it is proposed that the control station have an additional store (i.e., storage area) for full and empty cans.

Linking the central control unit with a central computer for the process control system further improves adaptation to the overall machine process of the instructions from the control unit to the carriage. In such instance, control of the central control unit is preferably subordinated to the control instructions of the central computer.

The proposed system, in which the carriage runs on a common guide track between the in-line delivery and receiving stations, and outside such common guide track on a loop (the control station being disposed on one such loop), advantageously obtains compactness (i.e., optimum use of available ground plan) through relatively short travels and the connection of a further conveying circuit.

BRIEF DESCRIPTION OF THE DRAWINGS

Other advantages Will be described and illustrated in greater detail hereinafter with reference to the following embodiments.

In the drawings.

DETAILED DESCRIPTION OF THE PREFERRED EMBODIMENTS

Figure 1:
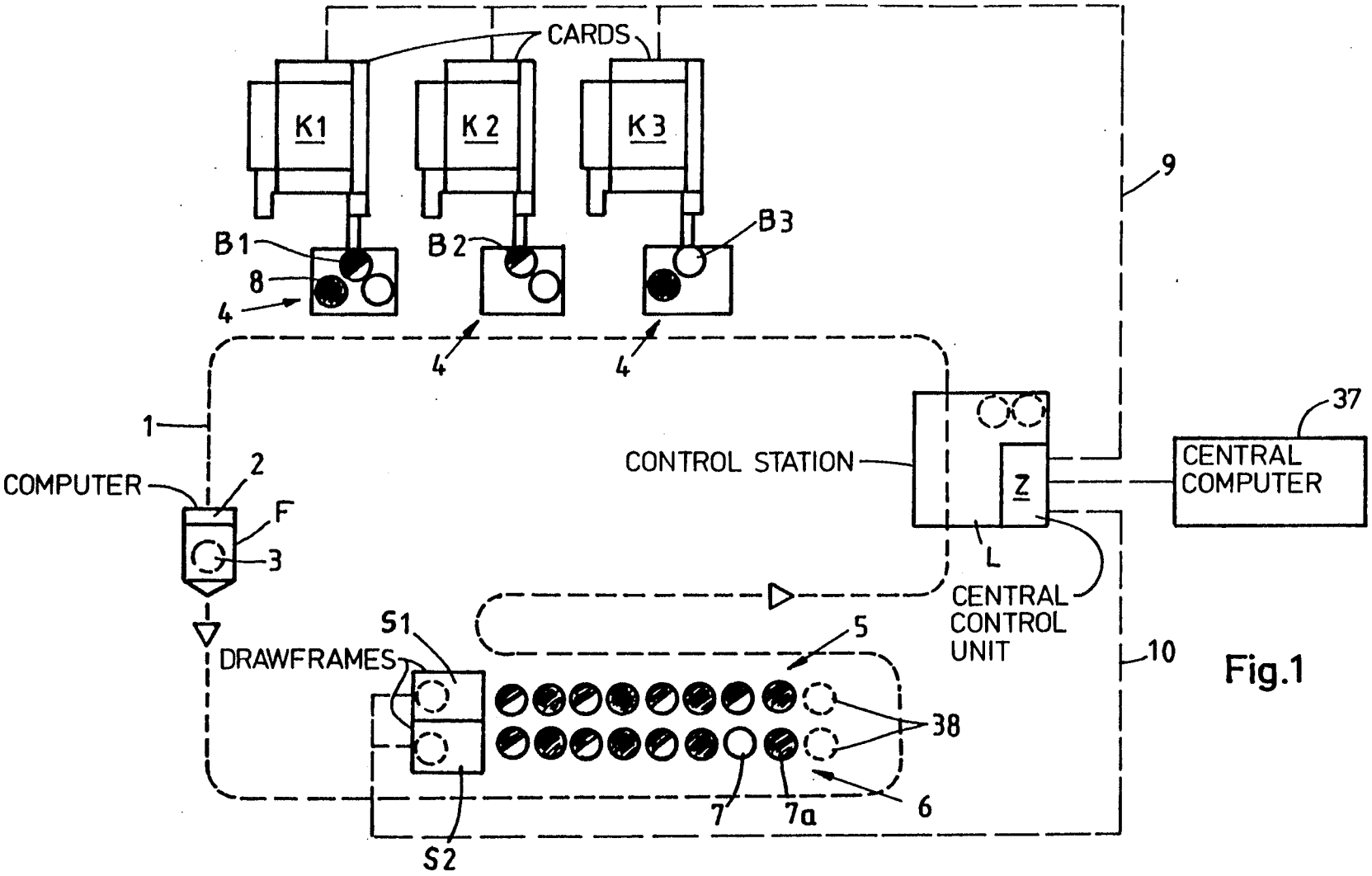
FIG. 1 illustrates one presently preferred exemplary embodiment through use of a diagrammatic plan view of a spinning preparation facility having three cards and two drawframes and a movable can conveyor.

Referring to FIG. 1, three cards (i.e., carding machines) K1 through K3 are represented as being disposed in line. The sliver produced on the cards is placed through means of a funnel wheel into cans (i.e.. recipients) B1 through B3. The cards have in addition to the sliver-receiving can other places (i.e., stations or locations) for empty and full cans. The latter of such places are effective as a kind of buffer. In the representative example shown, there is one place for a full can and one place for an empty can. Further can places may be provided in other embodiments.

Disposed after the cards K1 through K3 are two drawframes S1 and S2, which further process the textile material delivered by the cards. Textile material from the cards K1 through K3 may be forwarded to the drawframes S1 and S2 by a conveyor system embodied in this example by a carriage F running on a guide track 1. The carriage F has drive means (not further shown) and steering means, which may be controlled by sensors which sense track 1.

Carriage F also has a can place 3 (i.e., a location for receipt of a can) and an on-board computer 2. The computer 2 is effective (i.e., able) to record and process routing instructions received from a control station L. Computer 2 is also responsible for controlling can loading and unloading and responsible for an on-board steering mechanism. Carriage F may have further can places so that more than one can may be transported at a time.

In relation to the route of carriage F, control station L is disposed between the drawframes (S1 and S2) and the cards (K1 through K3).

In the illustrated example, the carriage preferably moves in only one direction. After it has passed delivery stations 4 of cards K1 through K3, the carriage moves along the creels 5 and 6 of the respective drawframes S1 and S2 before reaching the control station L. The transport loop is closed (i.e., completed) after the carriage F has passed the station L and returns to delivery stations 4 of cards K1 through K3.

Control station L has a central control unit Z linked for control purposes by way of respective cables 9 and 10 (i.e., communication lines) to the cards K1 through K3 and to the drawframes S1 and S2. For inclusion in an overall process control, unit Z may be linked with an overriding central computer 37.

Information is received through cable 9 concerning can place occupancy at the respective delivery stations 4 of the cards K1 through K3. Similarly, central control unit Z receives information from the respective drawframes S1 and S2 via cable 10 whenever a can in either creel 5 or 6 has run out of textile material or whenever no sliver is present because of a sliver break. Both events (i.e., either sliver breakage or an exhausted can) preferably trigger the same signal over cable 10.

In the example represented in FIG. 1, there has been a report (i.e., signal) via cable 10 from drawframe S2 that textile material in an exemplary can 7 in creel 6 has run out (i.e., been exhausted). Accordingly, reserve sliver from a reserve can 7*a* has been pieced up automatically by way of a feed-in device (not further shown). In the foregoing instance, the central control unit Z will function responsive to the mentioned signal on cable 10 to transmit to carriage F (originally present in a wait position or mode at control station L) an instruction to approach (i.e., travel to) creel 6 in order to fetch the exemplary empty can 7 thereat. To ensure an accurate approach to a given can place, the cans have discrete sensors or markings which cooperate with drive means of the carriage F by way of corresponding or coordinating sensors thereon. After the exemplary empty can 7 has been picked up through operation of a can handling facility (not further shown), carriage F with the empty can 7 received thereon enters control station L.

Figure 2:
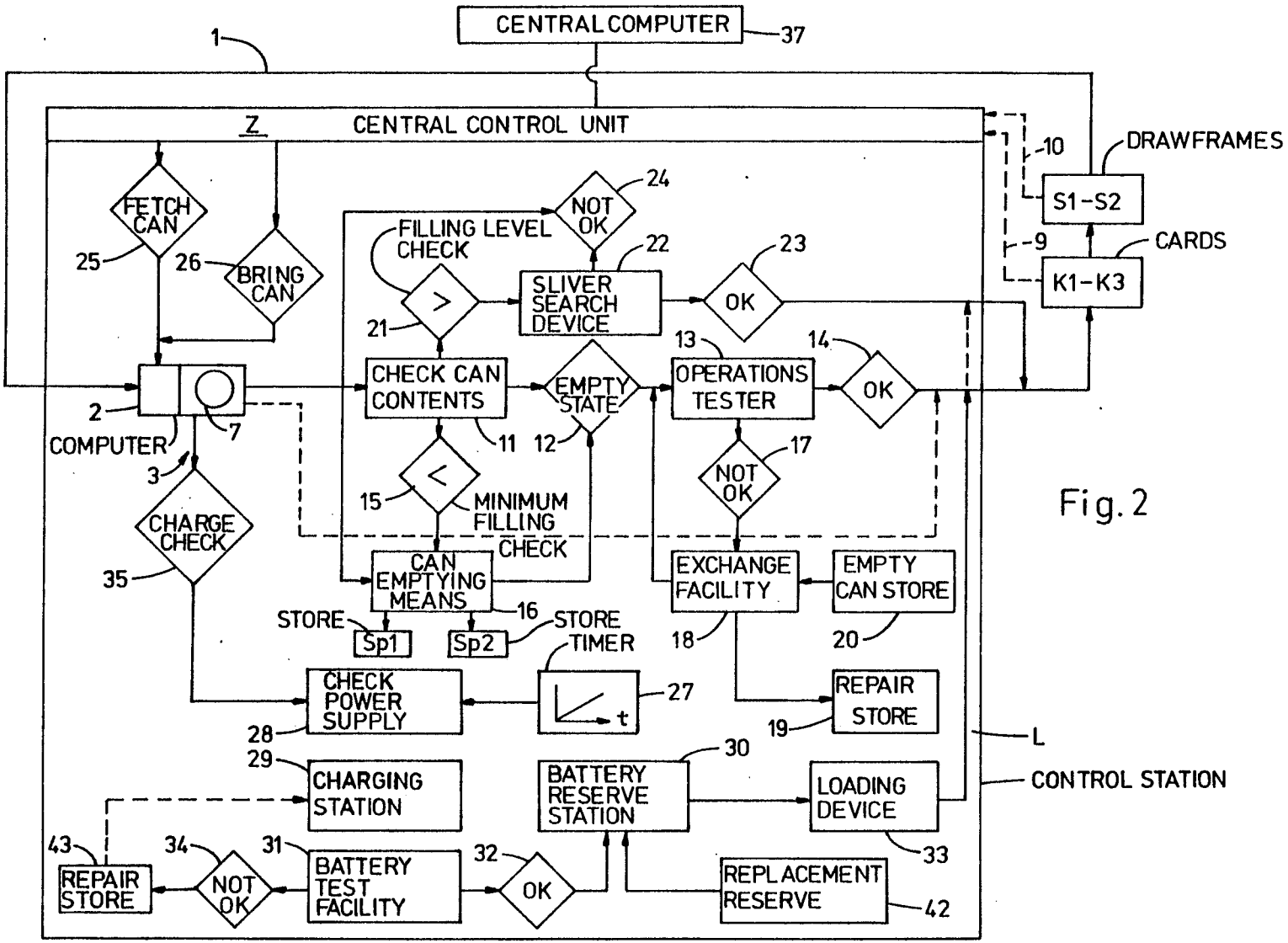
FIG. 2 is an exemplary flow diagram of an automatic control facility of a control station in accordance with this invention.

The following discussion is more particularly with reference to present FIG. 2. The can 7 received on carriage F is checked at the control station L with a level gauge 11 to determine whether any textile material is still present in the can. If can 7 is found to be in an "empty" state 12, it is tested for operation (i.e., the ability to perform its function) by means of an operations tester 13. Operations testing preferably is carried out only at predetermined intervals. If the result of the operations testing is satisfactory (see reference character 14), carriage F bearing such can 7 is released from the control station L and moves automatically to delivery station 4 of card K3. Empty can 7 is then deposited there at station 4 of card K3.

Whenever a signal is transmitted, for example, from the control station L to carriage F that an exemplary full can 8 of card K1 is ready for removal, carriage F moves to delivery station 4 of such card K1 and takes over (i.e., acquires) such full can 8. Such full can 8 is then transferred to the original, that is, the former, position of exemplary empty can 7 in creel 6 of the drawframe S2. After delivering such can 8, carriage F returns to its waiting position in control station L.

Another possibility is to provide on each of creels 5 and 6 an empty or unfilled can place, such as exemplary position 38 shown in dotted lines in FIG. 2. This helps to eliminate an idle (or empty) trip of the carriage F. In other words, on its way from control station L to drawframe S2, carriage F can transport a full can, such as 8, from card K1 and deposit it at the empty place 38 of drawframe S2. If carriage F is provided with at least limited capabilities for reversal, the exemplary empty can 7 can be taken up (i.e., handled) after deposition of full can 8 and transferred to control station L.

If in the operation at the control station L hereinbefore described the level gauge 11 detects a residue in the can less than a predetermined minimal filling (see reference character 15), the can is emptied by means 16 and the emptied material is supplied to a store Sp1 or Sp2. The now empty can is subjected to operations testing 13 as hereinbefore described. If such testing 13 proves negative (see reference character 17), an exchange facility 18 exchanges the can and guides it to a repair store or location 19. The exchange facility also supplies the can place 3 of the carriage F with a replacement can from an empty can store 20. In the example shown, such reserve can is also passed through the operations check facility 13.

Should the level gauge 11 indicate that the filling level 21 is above a minimal set value, a sliver search device 22 is activated and searches for the sliver start of the residue in the can being checked. If the response via report feature 23 is that the sliver "start is present," device 22 transfers the sliver start to retaining and transfer means (not further shown) of the carriage or can. The carriage is then released, after which it transfers the partly full can with the retained sliver start to the defective place of the drawframe S1 or S2.

When the sliver seeking device 22 issues a negative (i.e., sliver start "not found") report 24, the corresponding can is emptied by means of the facility 16 as in the operation just described.

While the carriage is present at control station L, the temporarily stored signals "fetch can" 25 or "bring can" 26 are transmitted to the carriage computer 2, from which the route to the can places to be approached is determined.

A timer 27 activates an exchange device 28 which removes the battery then carried on the carriage F and supplies it to a charging station 29. The recharged battery then passes to a test facility 31. If the testing shows a positive ("OK") value 32, the recharged battery is transferred to a reserve station 30 for subsequent use. Meanwhile, a reserve battery is also supplied by means of a loading device 33 from the reserve station 30 to the carriage F. In given embodiments, the exchange facility 28 and loading device 33 can be the same device.

If the function testing of the battery leads to a "fault" 34 (i.e., "not OK") indication, the battery is separated out to a repair store 43 and a new battery may be brought in manually or automatically from a replacement reserve 42. If the testing of the battery delivered to the store 43 shows that the battery is still serviceable, it is returned to the appropriate location to be subsequently used, after being recharged by the facility 29.

In addition to operation of timing element 27 which sets the exchange timings, carriage F has an additional charge check 35 which, if it detects a decreasing state of charge in the interim, can trigger the battery exchange operation at the control station L as hereinbefore described. Battery exchange periods can also be adapted to the duration of use. Battery changing timing is adapted to the other automatic functions by way of the central control unit Z. For the sake of greater clarity in FIG. 2, connecting lines between various operations and the central control unit Z are omitted. All the operations are, of course, linked together and administered by the central control unit Z.

Figure 3:
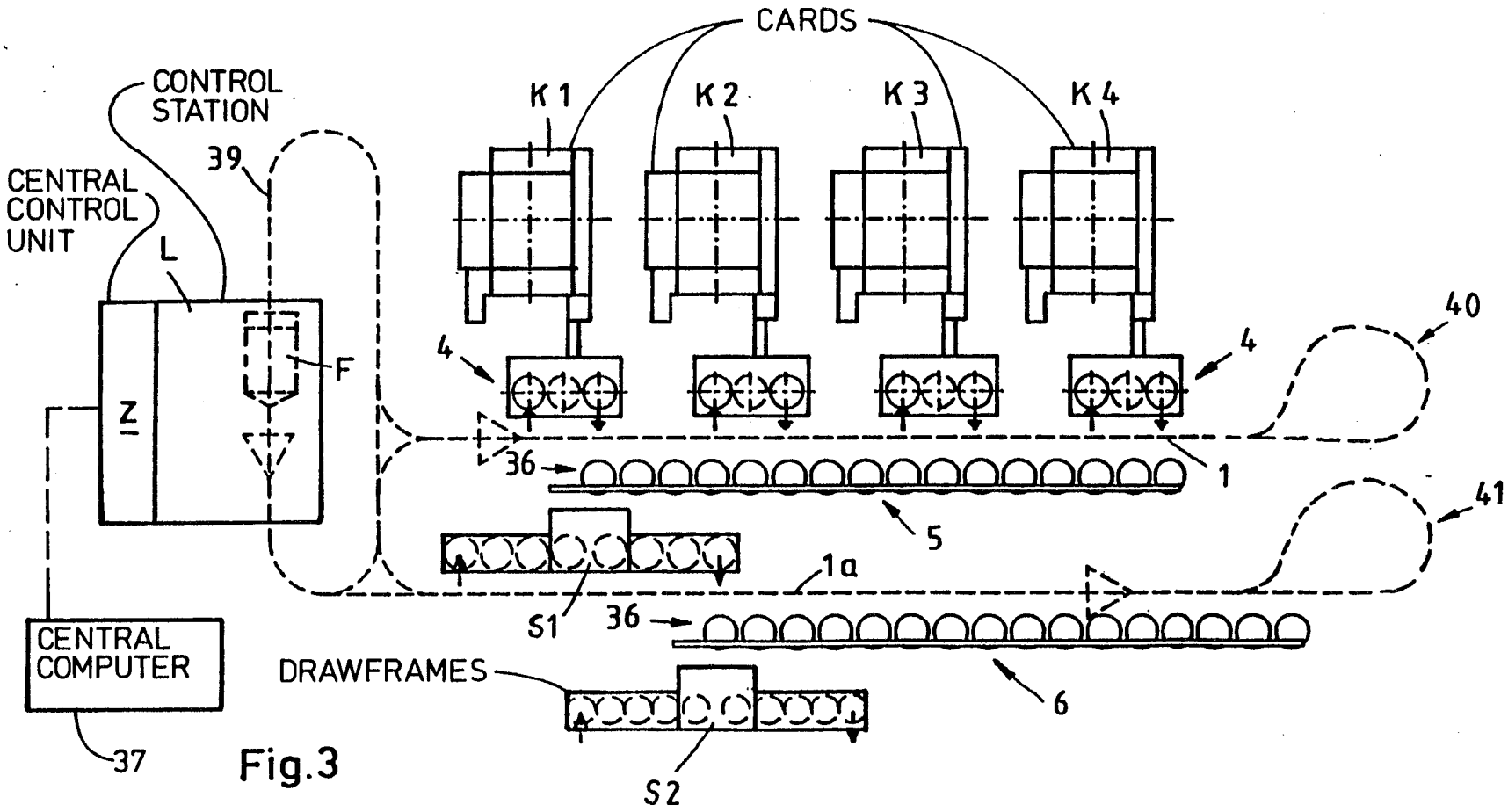
FIG. 3 shows another exemplary embodiment in accordance with this invention, and relative the illustration of present FIG. 1.

FIG. 3 shows another embodiment in which the carriage routes between the drawframe and the card overlap to some extent, and in which four textile material delivering cards K1 through K4 and one textile material receiving drawframe S1 are provide. By way of a further guide track 1*a* drawframe S1 is connected to a subsequent drawframe S2. Track 1*a* extends to a loop 39 of track 1. In this embodiment, loop 39 comprises control station L.

As illustrated for this alternate embodiment, there is a common track between the cards K1 through K4 and the creel 5 of the drawframe S1, while at the end remote from the loop 39 there is another track loop 40 for reversing or returning of the carriage F to the control station. However, another possibility in accordance with this invention is to provide two parallel close-together guide tracks between the cards K1 through K4 and the creel 5. Such an arrangement obviates additional outlay on control at the transition from the straight guide track 1 to the respective loops 40 and 39. The other guide track 1*a* also has a reversing loop 41.

The arrangement disclosed reduces to a minimum the time required for can changing at the control station.

Since the delivery stations 4 of the cards K1 through K4 and the receiving stations 36 are parallel to one another, the full cans can be transferred rapidly and directly to the receiving stations of the creel 5.

The further connection of a subsequent drawframe S2 further relieves the loading of the installed control station.

Advantageously, a second carriage may be used in this embodiment.

Except for the guide track layout, the procedure at the control station L and can changing are the same in the embodiments represented by FIG. 3 as in the embodiment of FIG. 1.

Those of ordinary skill in the art will appreciate that the invention is not limited to the foregoing embodiments, but that modifications thereto, for example such as variations in the sequence of operations, are possible. All such modifications and variations are intended to come within the spirit and scope of the present invention, which is further set forth in the appended claims.

We claim:

1. A method including:

conveying textile material in cans from at least one machine delivering textile material to at least one machine receiving textile material by means of self-propelled conveying carriage which is guided on a guide track and whose movements are controlled by a central control unit connected to the textile material delivering machine and to the textile material receiving machine;

returning to said textile material delivering machine cans emptied at said textile material receiving machine; and providing a control station on the path of said conveying carriage such that said carriage is passed through said central station on its way from said textile material receiving machine to said textile material delivering machine;

wherein the following operations are performed automatically at said control station;

transmission of routing instructions for the carriage by a central control unit incorporated in said control station;

checking can contents;

checking can condition; and exchanging, recharging, and checking a power supply on board said carriage.

2. A method according to claim 1, characterized in that upon detection of a predetermined condition, said carriage power supply is automatically exchanged at said control station for a spare battery power supply.

3. A method according to claim 2, wherein said power supply comprises a battery, and said predetermined condition comprises the detection of a low state of battery charge.

4. A method according to claim 2, wherein said power supply comprises a battery, and said predetermined condition comprises the detection of reaching a predetermined time.

5. A method according to claim 2, wherein said power supply comprises a battery, and said predetermined condition comprises the detection of reaching a predetermined impulse level.

6. A method according to claim 1, including the step of temporarily storing full and empty cans at said control station.

7. A method according to claim 1, further including the step that when a can is found to be partly empty to an extent not exceeding a predetermined extent of emptiness, such can is returned to said textile material receiving machine by way of said carriage.

8. A method according to claim 7, wherein the textile material is in the form of a sliver, and wherein said method further includes detecting automatically and delivering to retaining means a detected sliver start.

9. A method according to claim 1, wherein the textile material is in the form of a sliver, and wherein said method further includes the steps that if a can is found to be partly empty to an extent not exceeding a predetermined extent of emptiness, a sliver search device searches for the sliver start one or more times, and if it fails to find the sliver start after a predetermined number of search attempts the remaining contents of such can are removed and supplied for reworking.

10. A method according to claim 1, further including the step that if a can is found to be partly empty to an extent exceeding a predetermined extent of emptiness, the remainder of textile material in such can is removed and supplied for reworking.

11. A method according to claim 10, further including the step that said central control unit is operative so as to supply the remainder of textile material removed from the can in accordance with the previous position thereof on said textile material receiving machine to an intermediate store provided for such textile material.

12. A method according to claim 1, wherein said central control unit and said carriage each respectively include a computer, and wherein control instructions are transmittable form said central control unit to said computer on board the carriage only during the dwell thereof at said control station, with signals from said delivering and receiving machines being temporarily stored in a waiting queue of said computer of said central control unit while said carriage is outside said control station.

13. A method according to claim 1, further including a waiting position situated in said control station for said carriage.

14. A method according to claim 13, wherein said carriage is in a fixed waiting position at said control station during all automatic operations.

15. A method according to claim 1, wherein said can remains on the carriage during performance of automatic operations relative thereto at said control stations.

16. A method according to claim 1, wherein that for at least one of the automatic operations performed at said control station said can is removed from said carriage and transferred to a station of said control station.

17. A method according to claim 1, wherein said central control unit communicates with a central computer for a process control system which is operatively associated with said textile material delivering and receiving machines.

18. A method according to claim 1, wherein said checking can condition step is carried out at a predetermined time interval.

19. A method according to claim 1, further including at least two machines delivering textile material and at least two machines receiving textile material.

20. A system for conveying textile material in cans from at least two machines delivery textile material to at least two machines receiving textile material, comprising:

respective can-delivering stations for each of said machines delivering textile material, said can-delivering stations being disposed in a respective first row;

respective can-receiving stations for each of said machines receiving textile material, said can-receiving stations being disposed in a respective second row which is parallel to and opposite to said first row of can-delivery stations;

guide track including respective portions thereof parallel to said first and second rows, and with a respective closed guide track loop at both ends of such rows;

a control station disposed on one of said respective closed guide track loops;

a self-propelled, controllable can conveying carriage which is guided on said guide track for passing over said portions and loops thereof so as to be controllably and selectively guided passed said first and second rows and said control station, for conveying a can carried thereon from one location to another;

a central control unit, located at said control station, operatively interconnected with said respective machines delivering and receiving textile material so as to receive information therefrom, and operatively interconnected with said carriage and controllably moving same along said guide track responsive to said received information so as to return to said textile material delivering machines cans emptied at said textile material receiving machines; and means associated with said control station and automatically operative thereat for transmitting routing instructions from said central control unit to said carriage; for checking can contents; for checking can condition; and for exchanging, recharging, and checking a battery on board said carriage.

21. A system according to claim 20, wherein a further guide track element extends into said loop on which said control station is disposed and facilitates a conveying link from other textile material delivering and textile material receiving machines.

22. A method, comprising:

conveying textile material in cans and formed as a sliver respectively from a plurality of cards to a plurality of drawframes, via a can carrying carriage movable on a guide track under the control of a central control unit connected to said cards and drawframes;

returning to one of the cards cans selectively emptied at one of the drawframes; and providing a control station along said guide track and through which said carriage passes on its way from said drawframes to said cards;

wherein certain operations are performed automatically at said control station, and include:

transmission of routing instructions for said carriage from said central control unit;

checking can contents and condition; and exchanging, recharging, and checking a battery on board said carriage.

23. A method according to claim 22, further including automatically exchanging said battery for a spare battery whenever a predetermined condition is determined.

* * * * *